US005121150A

United States Patent [19]

Blackman

[11] Patent Number: 5,121,150

[45] Date of Patent: Jun. 9, 1992

[54] DRIVING AND TIMING BELT FOR A PHOTOGRAPHIC FILM PROCESSOR

[75] Inventor: Robert J. Blackman, Rochester, N.Y.

[73] Assignee: Eastman Kodak Company, Rochester, N.Y.

[21] Appl. No.: 478,877

[22] Filed: Feb. 12, 1990

[51] Int. Cl.[5] ..... G03D 3/13

[52] U.S. Cl. ..... 354/322; 354/321; 226/92; 226/172; 226/173

[58] Field of Search ..... 354/320, 321, 322; 226/92, 170, 171, 172, 173, 189

[56] References Cited

U.S. PATENT DOCUMENTS

| | | | |
|---|---|---|---|
| 1,991,137 | 2/1935 | Case et al. | 226/173 X |
| 2,869,865 | 1/1959 | Lechner | 226/173 |
| 3,032,247 | 5/1962 | Lechner | 226/173 |
| 3,599,555 | 8/1971 | Dutch | 354/322 |
| 4,613,221 | 9/1986 | Takase et al. | 354/321 |
| 4,736,222 | 4/1988 | Stromberg | 354/324 |
| 4,739,357 | 4/1988 | Zielinski | 354/321 |
| 4,758,858 | 7/1988 | Blackman et al. | 354/321 |
| 4,763,152 | 8/1988 | Blackman | 354/321 |
| 4,929,976 | 5/1990 | Cunningham et al. | 354/322 |

*Primary Examiner*—A. A. Mathews
*Attorney, Agent, or Firm*—Roger A. Fields

[57] ABSTRACT

A photographic film processor for conveying exposed film along a serpentine film path through a series of processing racks in a respective series of processing tanks, each processing rack including a sprocket-driven endless timing belt mounted for rotation on the rack and having outer teeth for engagement with an apertured film leader card to move the film leader card along a part of the path of the timing belt, the outer teeth being laterally expandable for positive engagement with the leader card, and contractible for disengagement from it. Alternatively, the outer teeth are laterally contractible for positive engagement with the leader card, and expandible for disengagement from it.

In another embodiment, the endless timing belt has spaced flexible edge tabs to pass through the apertures of a leader card to engage the card. One of the sprockets includes radial edge projections in spatial synchronism with the edge tabs of the belt to contact and flex the tabs radially outward in a position to pass through an aperture of a leader card to engage or disengage the card.

18 Claims, 3 Drawing Sheets

DRIVING AND TIMING BELT FOR A PHOTOGRAPHIC FILM PROCESSOR

BACKGROUND OF THE INVENTION

1. Field of the Invention

This invention relates to a photographic film processing apparatus in which exposed film is conveyed in a serpentine path through a series of processing stations for sequential contact with a series of processing liquids. More specifically, the invention relates to a driving and timing belt for engagement with a film leader card to lead an attached film through one or more such film processing stations.

2. Description of the Prior Art

The processing of photographic film involves a series of steps such as developing, bleaching, fixing, rinsing, and drying. These steps lend themselves to mechanization by conveying long strips of film sequentially through a series of stations or tanks, each one containing a different processing liquid appropriate to the process step at that station.

Typically, the film being processed is immersed in and drawn through a series of processing liquids by attachment to an apertured leader card which in turn is belt driven through a series of processing tanks.

The prior art includes U.S. Pat. No. 4,613,221 issued Sept. 23, 1986 to Takase et al, disclosing a film processor for conveying exposed film through a treating tank and having a sprocket-driven endless timing belt with spaced outer teeth moving through the tank, an apertured leader card for engagement with the belt and attached to the film for leading the film through the tank, and a guide member outward of the belt and the leader card to hold the card in operative engagement with the belt.

An object of this invention is to provide a timing belt for a film processor which does not require an outward guide member to hold the film leader card in engagement with the belt.

SUMMARY OF THE INVENTION

This invention may be summarized as an endless timing belt for a processing rack of a photographic film processor in which exposed film is conveyed along a serpentine path through a series of such processing racks. Each processing rack includes a drive sprocket and an idler sprocket on which the timing belt is rotatably mounted. The timing belt has outer teeth to engage an apertured film leader card to move the leader card along a part of its path. The outer teeth are split so as to be laterally expandable and contractible, in response to flexure of the belt, for positive engagement with and disengagement from the leader card. One of the sprockets is configured to correspond to the flexure of the belt in the expanded condition of its teeth, and the other sprocket is configured to correspond to the flexure of the belt in the contracted condition of its teeth. In one configuration, the belt teeth engage the leader card when laterally expanded. In another configuration, the belt teeth engage the leader card when laterally contracted.

In another embodiment, the endless timing belt has spaced flexible edge tabs to pass through the apertures of a leader card to engage the card. One of the sprockets includes radial edge projections in spatial synchronism with the edge tabs of the belt to contact and flex the tabs radially outward in a position to pass through an aperture of a leader card to engage or disengage the card.

DESCRIPTION OF THE PREFERRED EMBODIMENT

Figure 1:
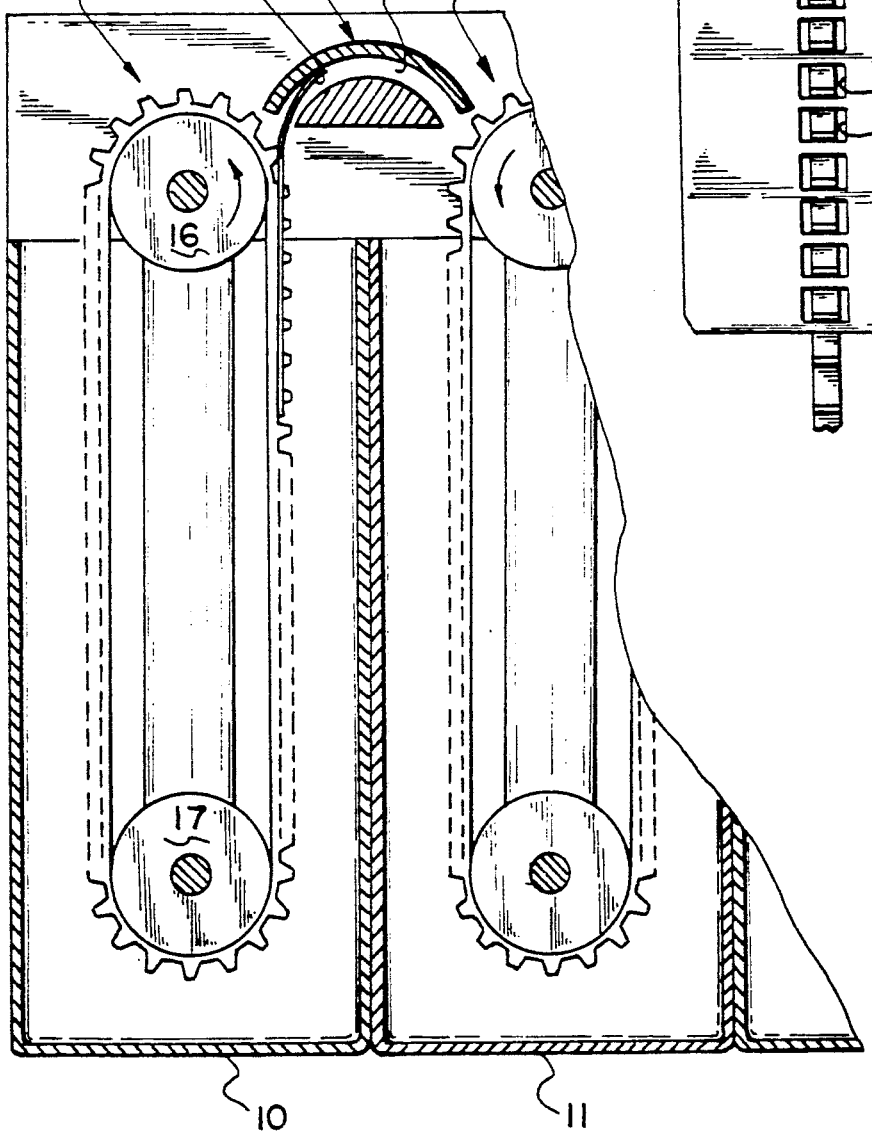
FIG. 1 is a schematic side elevation view of first and second film processing racks, immersed in respective processing tanks and joined by a crossover member, with a film leader card moving through the racks.

Referring to FIG. 1, a film processor is partially represented in side view to include a succession of film processing tanks 10, 11, and so on, each for containing an appropriate processing fluid. A first film processing rack 12 is positioned in the first processing tank 10. A second film processing rack 13 is positioned in the second processing tank 11. The two racks are joined by a crossover member 14 mounted to the rear half of processing rack 12 in tank 10 and to the front half of processing rack 13 in tank 11. Crossover member 14 includes a concave channel or guide 15 effecting a 180 degree or U-turn continuation of the serpentine film process path through the processing racks, in order to transport an exposed filmstrip in a continuous path from one processing tank to the next, and so on.

Each of the processing racks 12 and 13 includes an endless timing belt 30 extending over a drive sprocket 16 and under an idler sprocket 17 and in positive engagement with these sprockets for synchronous movement with them. Timing belts 30 each include inner peripheral teeth 31 and outer peripheral teeth 32.

Figure 2:
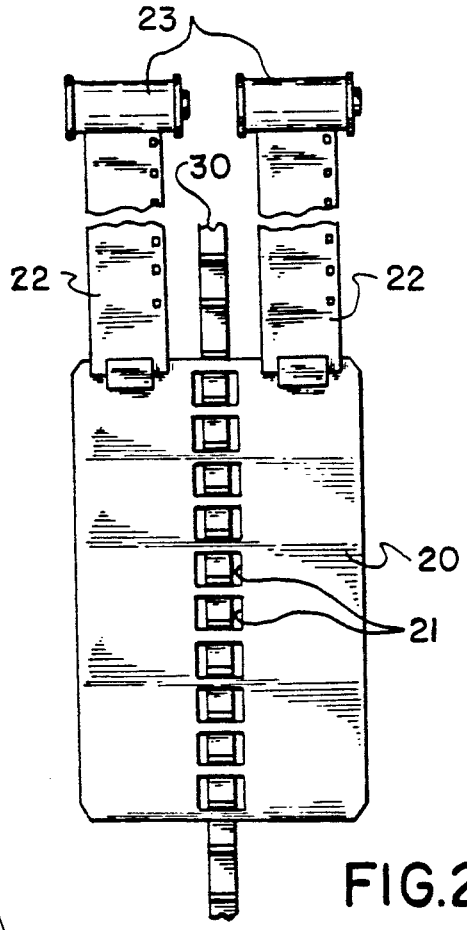
FIG. 2 is a front view of a film leader card showing its attachment to a pair of filmstrips and its engagement with a timing belt.

In FIG. 2, a rectangular leader card 20 is a thin flexible synthetic resin sheet having a series of square or rectangular apertures 21 spaced along its length. Two parallel exposed filmstrips 22 from film spools 23 are attached to the leader card 20. The leader card 20 with attached filmstrips 22 is introduced to the first processing rack 12 and engaged by the teeth of the timing belt 30. The timing belt drives the leader card and the attached filmstrips down one side and up the other side of the processing rack 12, from which the card emerges and enters the next successive processing rack 13, and so on. FIG. 2 is somewhat schematic; the details of timing belt 30 and its interaction with the leader card 20 are presented in connection with the subsequent detail views.

Referring back to FIG. 1, the leader card 20 is just emerging from the first processing rack 12, and entering the crossover member 14 on its way to the second processing rack 13.

Figure 3:
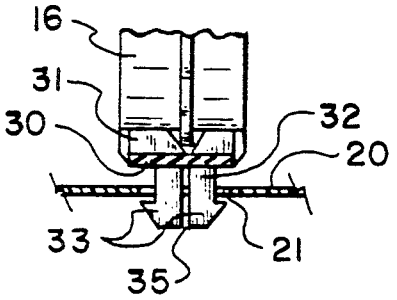
FIG. 3 is an enlarged sectional view at plane 3—3 of FIG. 1, and viewed from the right.
Figure 4:
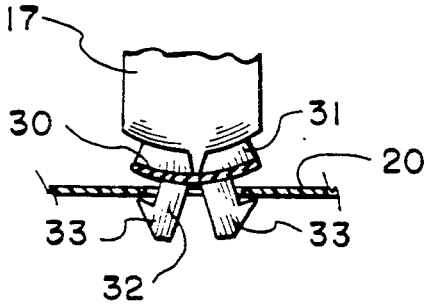
FIG. 4 is an enlarged sectional view at Plane 4—4 of FIG. 1, and viewed from the right.
Figure 5:
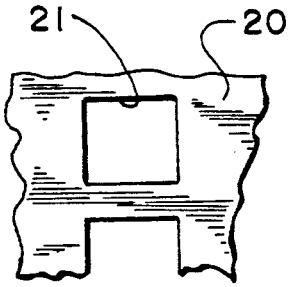
FIG. 5 is a front view of the portion of film leader card represented in FIGS. 3 and 4.

Reference is now to FIGS. 3-5. In FIG. 3, the timing belt 30 and drive sprocket 16 are shown at their point of contact. Timing belt 30 is shown with an inner tooth 31 engaging the drive sprocket 16, and an outer tooth 32 extending through an aperture 21 of a film leader card 20. Outer teeth 32 have axially (or laterally) outward extending hooks 33 at their tips. Outer teeth 32 are split in a central plane 35 and are flexible relative to plane 35. The line of tangency between belt 30 and sprocket 16 is a straight line. That is to say, the surface of sprocket 16 in the axial direction is "flat". This configuration of the sprocket forces the belt to lie correspondingly "flat" so that the two halves of tooth 32 extend straight out from the belt 30, with hooks 33 retracted and tooth 32 thus removable from the leader card aperture 21 without interference.

In FIG. 4, the timing belt 30 and idler sprocket 17 are shown in contact with an inner tooth 31 engaging the idler sprocket 17, and an outer tooth 32 extending through an aperture 21 of a film leader card 20. The lateral contact surface of sprocket 17 is convex, corresponding to the normal or relaxed condition of the belt which is concave inward relative to the central plane 35. In this condition, the two halves of tooth 32 extend divergently out from the belt 30, with hooks 33 extended so that tooth 32 is positively engaged with the leader card 20. FIG. 5 simply shows the form of the aperture 21 of leader card 20 required to function with the timing belt and teeth as shown in FIGS. 3 and 4.

Figure 6:
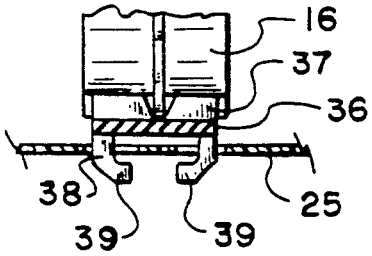
FIGS. 6, 7, and 8 are views similar to FIGS. 3, 4, and 5 respectively of an alternative configuration of timing belt and leader card.
Figure 7:
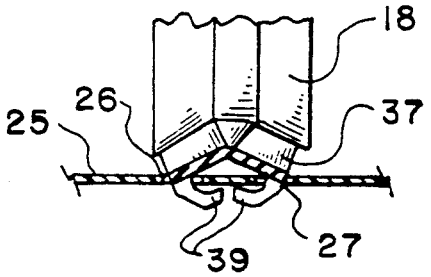
Figure 8:
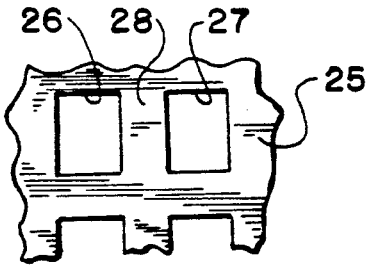

Reference is now to FIGS. 6-8, showing an alternative configuration of timing belt and leader card. In FIG. 6, a timing belt 36 and drive sprocket 16 are shown at their point of contact. Timing belt 36 is shown with an inner tooth 37 engaging the drive sprocket 16, and a pair of outer teeth 38 extending through apertures 26 and 27 of a film leader card 25. Outer teeth 38 have axially (or laterally) inward extending hooks 39 at their tips. Outer teeth 38 are symmetrical about a central plane 35 and are flexible relative to plane 35. The line of tangency between belt 36 and sprocket 16 is a straight line. That is, as in FIG. 3, the surface of sprocket 16 in the axial direction is "flat". This configuration of the sprocket forces the belt to lie correspondingly "flat" so that the two teeth 38 extend straight out from the belt 36, with hooks 39 retracted and teeth 38 extend straight out from the belt 36, with hooks 39 retracted and teeth 38 thus removable from the leader card aperture 26 and 27 without interference.

In FIG. 7, the timing belt 36 and an idler sprocket 18 are shown in contact with an inner tooth 37 engaging the idler sprocket 18, and outer teeth 38 extending through apertures 26 and 27 of a film leader card 25. The lateral contact surface of sprocket 18 is concave, corresponding to the normal or relaxed condition of the belt which is concave outward relative to the central plane 35. In this condition, the two outer teeth 38 extend convergently out from the belt 36, with hooks 39 inwardly grappling the center strip 28 of the leader card 25 for positive engagement with the leader card. FIG. 8 simply shows the form of the leader card 25, its apertures 26 and 27, and its center strip required to function with the timing belt and teeth as shown in FIGS. 6 and 7.

Figure 9:
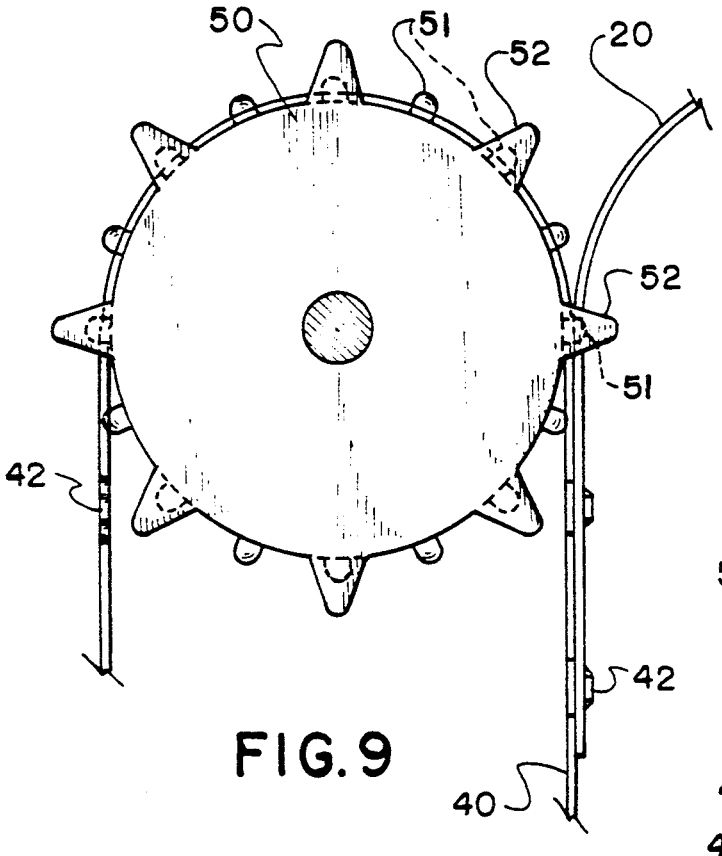
FIG. 9 is an enlarged side detail of another embodiment of this invention.
Figure 10:
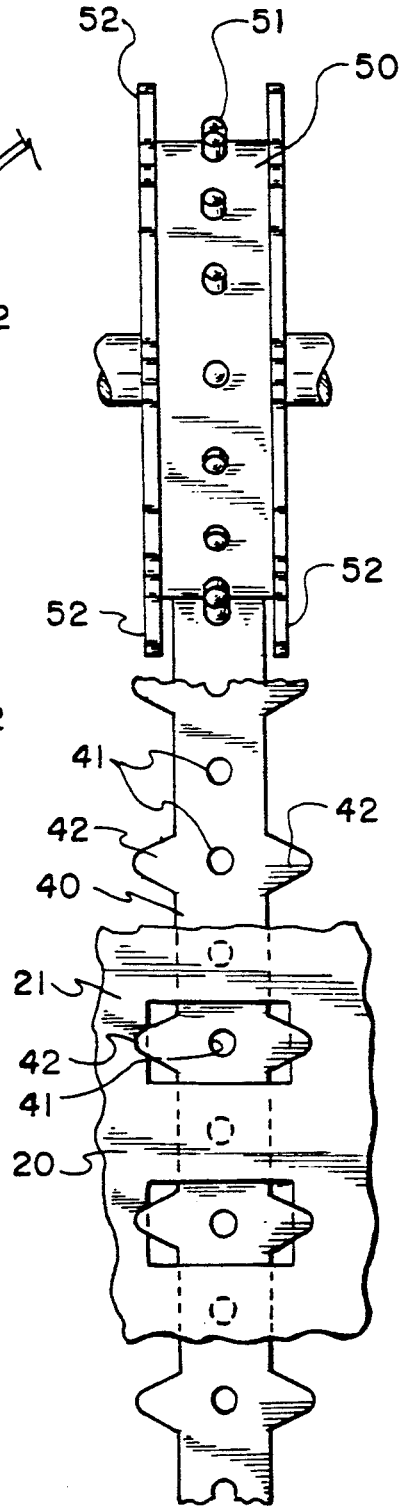
FIG. 10 is a front view from the right of FIG. 9.
Figure 11:
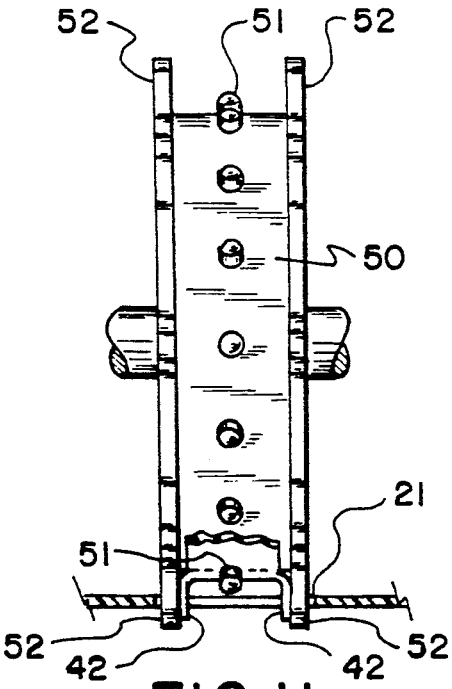
FIG. 11 is a top view of FIG. 10.

Referring now to FIGS. 9-11, another embodiment of this invention is shown and includes a drive sprocket 50 in engagement with a timing belt 40 for moving a leader card 20. The belt 40 is shown to have spaced central holes 41 for synchronous engagement by the central teeth 51 of the sprocket 50. Holes 41 and teeth 51 are not essential. The sprocket might instead have teeth similar to those in FIG. 1, and the timing belt might instead have inner teeth similar to those of belts 30 and 36. Timing belt 40 includes a number of edge tabs 42 extending laterally from each edge of the belt and spaced around the periphery of the belt to correspond with the spacing of apertures of leader card 20. Edge tabs 42 are flexible to be bent radially outward from their normal spread position (shown in FIG. 10) so as to permit their passage, without interference, through apertures 21 for engaging and disengaging the leader card 20.

Sprocket 50 includes radial edge projections 52 extending from each side of the sprocket and spaced to correspond with the spacing of the edge tabs 42 on the timing belt. In FIG. 10, the belt 40 is transporting a leader card upward toward the drive sprocket 50. As each pair of edge tabs 42 comes into contact with a pair of sprocket projections 52, the projections push the edge tabs radially outward into a U shape (see FIG. 11) so that they will fit through an aperture 21 of the leader card to engage or disengage the leader card as appropriate.

FIG. 11 shows the sprocket and leader card about to disengage. When the card now advances to the entrance of the next processing rack, the sprocket and belt of that rack will engage the card in the same way that disengagement was effected. That is, the sprocket will push the tabs outward so that they may pass through the card apertures. Further rotation of the sprocket moves the radial projections out of operative engagement with the belt, and the edge tabs relax to their spread condition in positive engagement with the leader card.

In all of the above-described embodiments, a timing belt positively engages an apertured leader card to transport the card through a curved path without the need of an outward guide member to hold the card in operative engagement with the belt.

The invention has been described with reference to preferred embodiments thereof. It will be appreciated that variations and modifications can be effected within the ordinary skill in the art without departing from the scope of the invention.

What is claimed is:

1. A photographic film processor for conveying exposed film along a serpentine film path through a series of processing racks in a respective series of processing tanks with a leader card having spaced apertures, each said processing rack including:

an endless timing belt mounted for rotation on said processing rack and having outer teeth for operative engagement with the apertured film leader card to move said film leader card along a part of the path of said timing belt;

said outer teeth being laterally expandable for positive engagement with said leader card through the apertures, and contractible for disengagement from said leader card.

2. A photographic film processor for conveying exposed film along a serpentine film path through a series of processing racks in a respective series of processing tanks with a leader card having spaced apertures, each said processing rack including:

an endless timing belt mounted for rotation on said processing rack and having outer teeth for operative engagement with the apertured film leader card to move said film leader card along a part of the path of said timing belt;

said outer teeth being laterally contractible for positive engagement with said leader card through the apertures and expandable for disengagement with said leader card.

3. A photographic film processor for conveying exposed film along a serpentine film path through a series of processing racks in a respective series of processing tanks with a leader card having spaced apertures, each said processing rack having a drive sprocket and an idler sprocket rotatably mounted thereon and including:

an endless timing belt having an inner periphery for mating engagement with said sprockets and outer teeth for operative engagement with the apertured film leader card through the apertures to move said film leader card along a part of the path of said timing belt;

said outer teeth being split in the central plane of said belt so that said outer teeth are laterally expandable and contractible in response to flexure of said belt relative to said central plane for positive engagement with and disengagement from said leader card: and one of said sprockets being configured to correspond to the flexure of said belt in the expanded condition of said outer teeth, and the other of said sprockets being configured to correspond to the flexure of said belt in the contracted condition of said outer teeth.

4. A photographic film processor as defined in claim 3 in which said outer teeth are laterally expandable and contractible in response to flexure of said belt relative to said central plane for, respectively, positive engagement with and disengagement from said leader card; and said idler sprocket is configured to correspond to the flexure of said belt in the expanded condition of said outer teeth, and said drive sprocket is configured to correspond to the flexure of said belt in the contracted condition of said outer teeth.

5. A photographic film processor as defined in claim 3 in which said outer teeth are laterally contractible and expandable in response to flexure of said belt relative to said central plane for, respectively, positive engagement with and disengagement from said leader card; and said idler sprocket is configured to correspond to the flexure of said belt in the contracted condition of said outer teeth, and said drive sprocket is configured to correspond to the flexure of said belt in the expanded condition of said outer teeth.

6. Apparatus for supporting and transporting an apertured member having spaced apertures along a path, said apparatus comprising:

an endless belt having peripheral outer teeth for engaging and disengaging the apertured member to drive the apertured member along a part of the path of said belt;

said outer teeth being laterally expandable for positive engagement with the apertured member through the apertures, and contractible for disengagement from the apertured member.

7. Apparatus as defined in claim 6 in which said outer teeth include lateral outwardly extending hooks to effect said positive engagement with said apertured member.

8. Apparatus for supporting and transporting an apertured member having spaced apertures along a path, said apparatus comprising:

an endless belt having peripheral outer teeth for engaging and disengaging the apertured member to drive the apertured member along a part of the path of said belt;

said outer teeth being split in the central plane of said belt so that said outer teeth are laterally expandable and contractible in response to flexure of said belt relative to said central plane for positive engagement with and disengagement from the apertured member through the apertures.

9. Apparatus as defined in claim 8 in which said outer teeth are laterally expandable and contractible in response to flexure of said belt relative to said central plane for, respectively, positive engagement with and disengagement from said apertured member.

10. Apparatus as defined in claim 9 in which said outer teeth include lateral outwardly extending hooks to effect said positive engagement with said apertured member.

11. Apparatus as defined in claim 8 in which said outer teeth are laterally contractible and expandable in response to flexure of said belt relative to said central plane for, respectively, positive engagement with and disengagement from the apertured member.

12. Apparatus as defined in claim 11 in which said outer teeth include lateral inwardly extending hooks to effect said positive engagement with the apertured member.

13. Apparatus for supporting and transporting an apertured member having spaced apertures along a path, said apparatus comprising:

an endless belt having peripheral outer teeth for engaging and disengaging the apertured member to drive the apertured member along a part of the path of said belt;

said outer teeth being laterally contractible for positive engagement with the apertured member through the apertures thereof, and expandable for disengagement from the apertured member.

14. An endless belt as defined in claim 13 in which said outer teeth include lateral inwardly extending hooks to effect said positive engagement with the apertured member.

15. A photographic film processor for conveying exposed film along a serpentine film path through a series of processing racks in a respective series of processing tanks with an apertured leader card, each said processing rack having a drive sprocket and an idler sprocket rotatably mounted thereon, said apparatus comprising:

an endless timing belt adapted for mating engagement with said sprockets and having spaced flexible edge tabs for operative engagement with the apertured film leader card to move said film leader card along a part of the path of said timing belt, said edge tabs being spaced correspondingly with the apertures of said leader card and adapted to engage and disengage said leader card through said apertures; and one of said sprockets including radial edge tabs of said belt and effective on contact with said edge tabs to push said edge tabs radially outward to engage and disengage the leader card through the apertures thereof.

16. Apparatus for supporting and transporting an apertured member having spaced apertures along a path, said apparatus comprising:

an endless belt having spaced flexible edge tabs for engaging and disengaging the apertured member to drive said apertured member along a part of the path of said belt, said edge tabs in their relaxed and unflexed state lying in the cylindrical locus of said belt, said edge tabs being spaced correspondingly with the apertures of said apertured member and adapted to bend radically outward in response to motive force to engage and disengage said apertured member through said apertures.

17. A photographic processor for conveying exposed film or paper webs along a serpentine path through a series of processing racks in a respective series of processing tanks with a leader card having spaced apertures, each said processing rack having a drive sprocket and an idler sprocket rotatably mounted thereon, said processor comprising:

an endless timing belt for mating engagement with said sprockets and having spaced yieldably members for operative engagement with the apertured leader card to transport said leader card along a part of the path of said timing belt, said yieldable members being spaced correspondingly with the apertures of said leader card and being yieldable to engage and disengage said leader card through said apertures, said yieldable members and said belt solely supporting said card during its transport by said belt.

18. Apparatus for supporting and transporting an apertured member having spaced apertures along a predetermined path, said apparatus comprising:

an elongated belt; and spaced yieldable members on said belt for operative engagement with the apertured member to transport the apertured member along the predetermined path, said yieldable members being spaced complimental to the spacing of the apertures of the apertured member and being yieldable to engage and disengage said apertured member through the apertures of the apertured member, said yieldable members and said belt solely supporting said apertured member during its transport by said belt.

* * * * *